United States Patent [19]

Laauwe

[11] 4,122,979

[45] Oct. 31, 1978

[54] SQUEEZE BOTTLE CONTAINING A LIQUID PRODUCT AND OPERATIVE WHETHER UPRIGHT OR INVERTED

[76] Inventor: Robert H. Laauwe, 237 Green Ridge Rd., Franklin Lakes, N.J. 07417

[21] Appl. No.: 789,189

[22] Filed: Apr. 20, 1977

Related U.S. Application Data

[63] Continuation-in-part of Ser. No. 691,709, Jun. 1, 1976.

[51] Int. Cl.[2] ..... B65D 83/06

[52] U.S. Cl. ..... 222/193; 222/211

[58] Field of Search ..... 222/207, 211, 209, 376, 222/402.11, 402.18, 402.19, 193; 137/43; 239/327

[56] References Cited

U.S. PATENT DOCUMENTS

| | | | |
|---|---|---|---|
| 2,904,229 | 9/1959 | Samuel | 222/376 X |
| 3,224,648 | 12/1965 | Zimmermann | 222/193 |
| 4,020,979 | 5/1977 | Shay et al. | 222/211 |

*Primary Examiner*—Joseph F. Peters, Jr.
*Assistant Examiner*—Norman L. Stack, Jr.
*Attorney, Agent, or Firm*—Kenyon & Kenyon, Reilly, Carr & Chapin

[57] ABSTRACT

A squeeze bottle containing a liquid product, such as antiperspirant and the like, has a dispensing nozzle internally forming a swirl chamber having opposed orifices each having its own inlet. One inlet is connected with a dip tube that dips into the liquid when the bottle is upright, and the other inlet connects with an air space above the liquid when the bottle is upright. When the bottle is squeezed, the swirl chamber receives opposed jets of the liquid and air, producing an atomized spray. When the bottle is inverted, the dip tube opens into the air space formed in the bottom of the inverted bottle, while the other inlet is connected with the liquid so that again opposed liquid and air jets enter the swirl chamber. However, to prevent the liquid component in the swirl chamber from being excessive relative to the air component, the inlet now receiving the liquid is provided with a check valve which closes when the bottle is inverted while providing for a restricted flow rate of appropriate proportioning relative to the air received through the dip tube. During upright operation, the check valve opens so that the flow of air is also in this instance appropriately proportioned relative to the flow of liquid.

9 Claims, 16 Drawing Figures

Fig. 1.
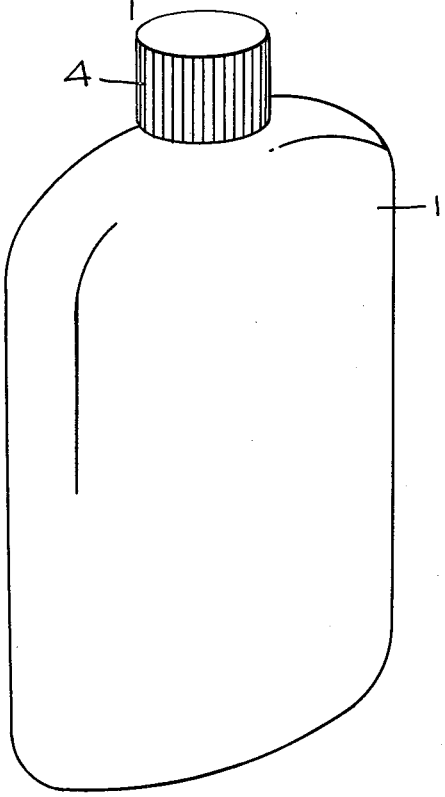
Fig. 2.
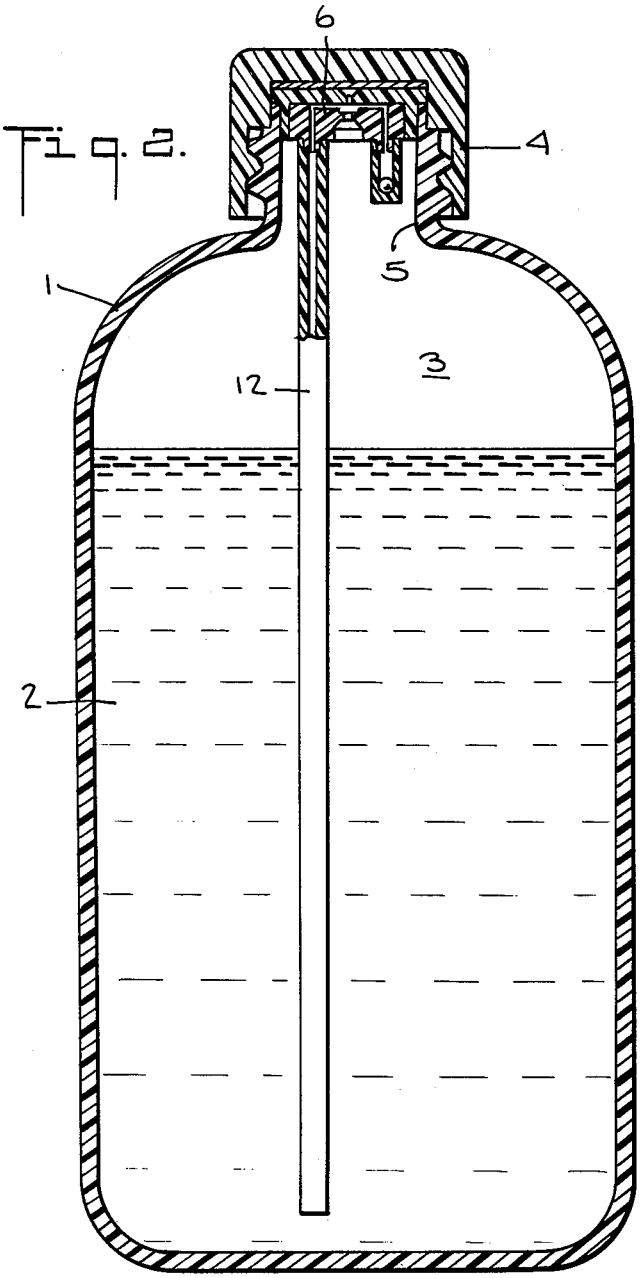
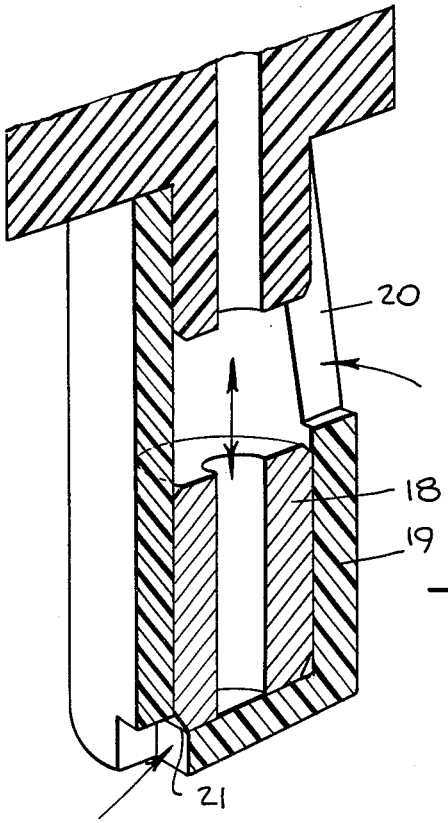
Fig. 6.
Fig. 5.
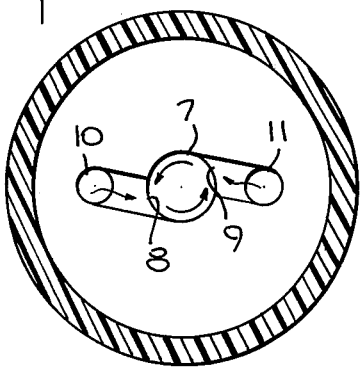

30
35a
31
35
32
33
34

35a
35
39
46
33
40
41
42
44
45
34
47
36
37
9
39
40
38b
38a
42
10
41
44
43

37
39
38
42
41
40

Fig.13.
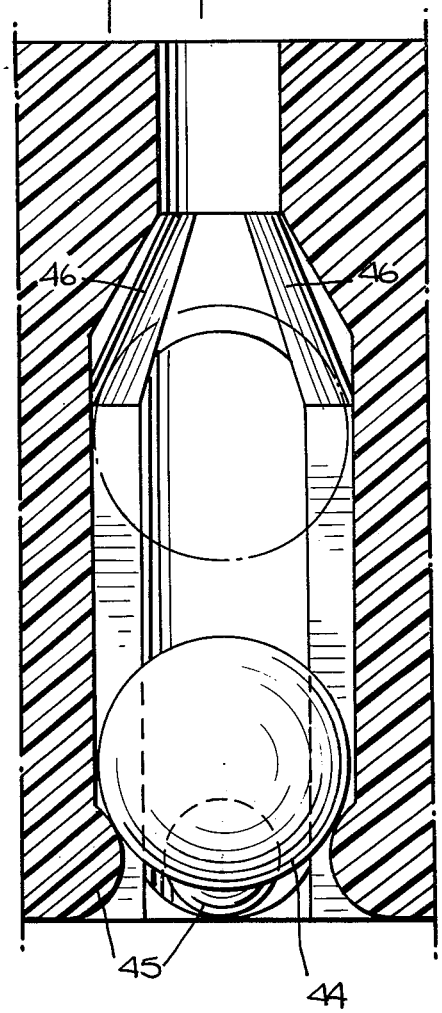
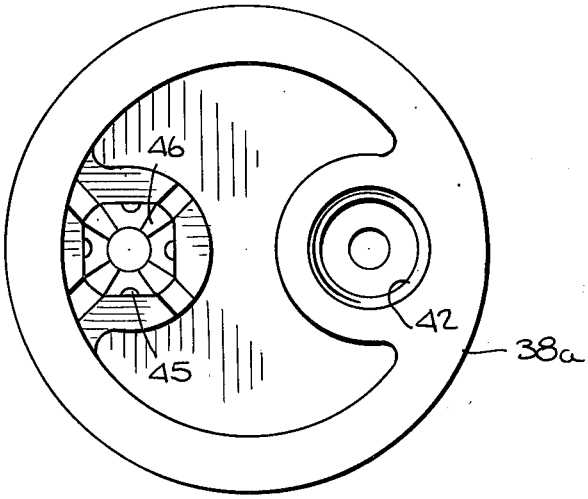
Fig.10.
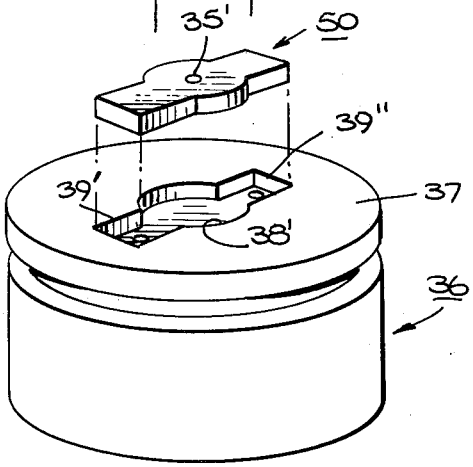
Fig.15.
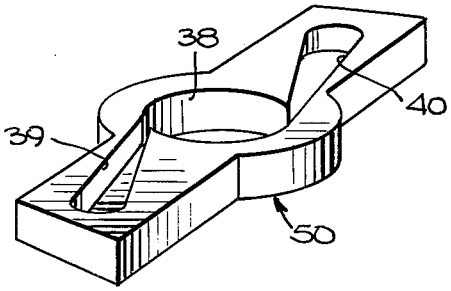
Fig.16.
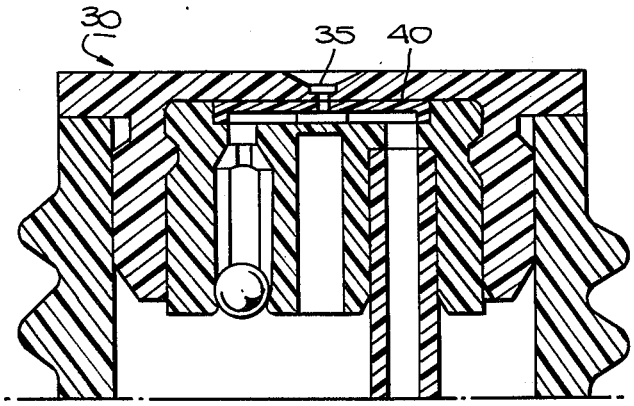
Fig.14.

SQUEEZE BOTTLE CONTAINING A LIQUID PRODUCT AND OPERATIVE WHETHER UPRIGHT OR INVERTED

This application is a continuation-in-part of application Ser. No. 691,709 filed June 1, 1976.

BACKGROUND OF THE INVENTION

The text "AEROSOLS: Science and Technology," copyright 1961 by Interscience Publishers, Inc. New York, N.Y., tells the history of the familiar aerosol package which until recently has satisfactorily provided the public with a means for dispensing liquid formulations in the form of a spray having a particle size range small enough to qualify as an aerosol.

That text describes how a liquified compressed gas propellant can pressurize the package with vapor pressures ranging from 15 to 100 psi at 70° C., with the best performance being obtained from the higher pressures; how the propellant flash vaporizes to form an aerosol when ejected through the actuator of the package upon opening its aerosol valve, and how, with some formulations, mechanical breakup actuators can be used, when necessary, to produce an aerosol spray. In addition the use of aerosol valves having vapor taps is described together with information that aerosol valves can be designed like a vapor tap valve but with the tap provided with a normally closed valve which gravitationally opens when the package is used in an inverted position, as disclosed by the Samuel U.S. Pat. No. 2,793,794, May 28, 1957.

After publication of that text, the Samuelson et. al U.S. Pat. No. 3,542,254, issued on Nov. 24, 1970, disclosing an aerosol valve adaptor for a vapor tap aerosol valve and intended to provide for anyway operation of an aerosol package in conjunction with metering of the flow rates of the liquid and vapor components of the package, depending on the position of the package.

Unfortunately, now that the aerosol science and technology has reached a high degree of advancement with full customer acceptance of aerosol packages, these packages have fallen into disrepute because of allegations that fluorocarbon propellants may pollute the stratosphere while the use of hydrocarbon propellants produces packages which are potentially lethal flame throwers by ignition of the spray.

Currently, liquid product manufacturers who have been merchandizing their products in aerosol packages, are turning to manually operated pump packages. A pump dispenser is normally made with a small pump piston area which when the pump is finger operated is consequently capable of pressurizing the liquid product for ejection under high pressures such as those obtained by the liquified gas propellants of aerosol packages; an acceptable spray is then made possible. However, pump-type liquid dispensing packages are more expensive to manufacture and less convenient to use, when compared to the aerosol package.

Squeeze bottle liquid dispensing packages are inexpensive and convenient to use, certainly as compared to the pump-type package and even when compared to the aerosol package.

The problem with squeeze bottles has been that the internal pressure that can be developed by finger pressure to dispense a liquid product by squeezing the squeeze bottle, is much less than can produce a dispensed spray comparable to that provided by aerosol and pump packages using the presently existing science and technology developed in those fields.

Prior art patented proposals are exemplified by the following:

Leong U.S. Pat. No. 1,716,525, June 11, 1929, shows the basic principle used up to date to dispense a spray of liquid droplets via a squeeze bottle. Squeezing of the bottle expels the liquid through an orifice with the air through another orifice, jetting right angularly over the liquid, the mixture ejecting through a dispensing nozzle.

Armour U.S. Pat. No. 2,980,342, Apr. 18, 1961, shows a liquid spray dispensing squeeze bottle package using fundamentally the Leong patent principle modified to permit anyway operation.

Roote U.S. Pat No. 2,981,444, Apr. 25, 1961, for powder and not liquid, but which does propose a squeeze bottle using the basic Leong patent concept and, in addition, the gravity actuated valving and metering of the Samuelson et al. patent.

Lee U.S. Pat. No. 3,493,179, Feb. 3, 1970, proposes a squeeze bottle which to obtain a spray from a liquid content, uses the mechanical breakup concept of the aerosol industry.

SUMMARY OF THE INVENTION

According to the present invention, a squeeze bottle containing the liquid product to be dispensed and the usual air space, has a dispensing nozzle internally forming a swirl chamber having opposed orifices each having its own inlet. One inlet is provided with the usual dip tube extending into the liquid product when the container is upright. The other of the inlets has a check valve means for connecting it with the end space when the container is upright and providing a flow rate proportioned so that when the bottle is squeezed by finger pressure there is enough air pressure produced to eject the liquid through the dip tube and via that one of the inlets for ejection through the swirl chamber orifice supplied by that inlet, while, at the same time, providing enough air to the swirl chamber, via the check valve means and the opposite or other one of the swirl chamber orifices, to atomize the liquid for dispensing in spray form, the dispensing nozzle providing a discharge orifice coaxially with respect to the swirl chamber. When the bottle is inverted, this flow rate that was suitable for the air would introduce an excess of liquid to the swirl chamber relative to the air injected from the bottle's air space now above the liquid, when the bottle is squeezed while inverted. Therefore, the check valve means is designed to close when the bottle is inverted while being designed to provide for a much lower flow rate but still such that the liquid and air in properly proportioned amounts for atomization and the ejection of a spray via the dispensing nozzle swirl chamber discharge orifice, are provided.

In the above way, when squeezed, the squeeze bottle ejects an atomized spray whether it is held upright or inverted.

The mechanical breakup actuator concept used by the aerosol industry and previously proposed for a squeeze bottle dispensing nozzle, as exemplified by the Roote patent, also uses a swirl chamber design embodying two orifices ejecting tangentially in the same rotative direction into a swirl chamber from which a product is ejected through a discharge orifice. However, in all known examples of that prior art practice, the liquid product, possibly premixed with vapor or air, is ejected as a single component through all of the jet orifices into the swirl chamber. The liquid is not discharged as one component through one of the swirl chamber's tangential orifices while air or vapor is discharged as a second component through the other of the orifices so that the two separate components intermix only while swirling together in the swirl chamber prior to exiting through the discharge orifice with which the chamber connects.

The present invention has been actually reduced to practice via both prototype and commercial designs. Surprisingly, using only the low pressure that can be developed by finger squeezing of the squeeze bottle, the ejected spray has all of the characteristics of an aerosol spray. The particle size of the spray and the spray pattern are substantially the same as can be produced by either aerosol or pump-type spray dispensing packages. At the same time, the propellant is only the air compressed by finger pressure squeezing of the squeeze bottle, the air pressure being estimated as being in the area of 5 psi. Air is free from all of the current objections to the use of either type of liquified compressed gas propellants used to pressurize an aerosol package. Operation of the squeeze bottle equals or approximates the operating convenience of an aerosol package, when operated by either the left or right hand of the user, overcoming the problems encountered under the same circumstances by the operation of the pump-type package. The manufacturing cost of this new squeeze bottle is very substantially less than that of the pump-type package or the aerosol package.

The foregoing advantages of this new squeeze bottle are obtained even when the bottle is designed for the upright-only position to which aerosol packages and pump-type packages are mainly limited when produced in large quantities. When this new squeeze bottle is designed for spray-anyway operation, it provides for an aerosol spray in either upright or upsidedown operation positions while permitting its manufacturing cost to be kept below that of aerosol and pump-type packages designed for upright operation only.

In the original patent application, the prototype of this invention was disclosed, while in the present application this disclosure is repeated together with a disclosure of the form designed for commercial production and sale.

BRIEF DESCRIPTION OF THE DRAWINGS

A specific example of the present invention in its prototype form of the original application is illustrated by the accompanying drawings in which:

FIG. 1 in perspective shows the bottle;

FIG. 2 in vertical section shows the internal construction of the new bottle;

FIG. 5 is a cross section taken on the line VI—VI in FIG. 3; and

FIG. 6 in section shows a modification of the check valve shown by the preceding figures.

Figures 7, 8, 9:
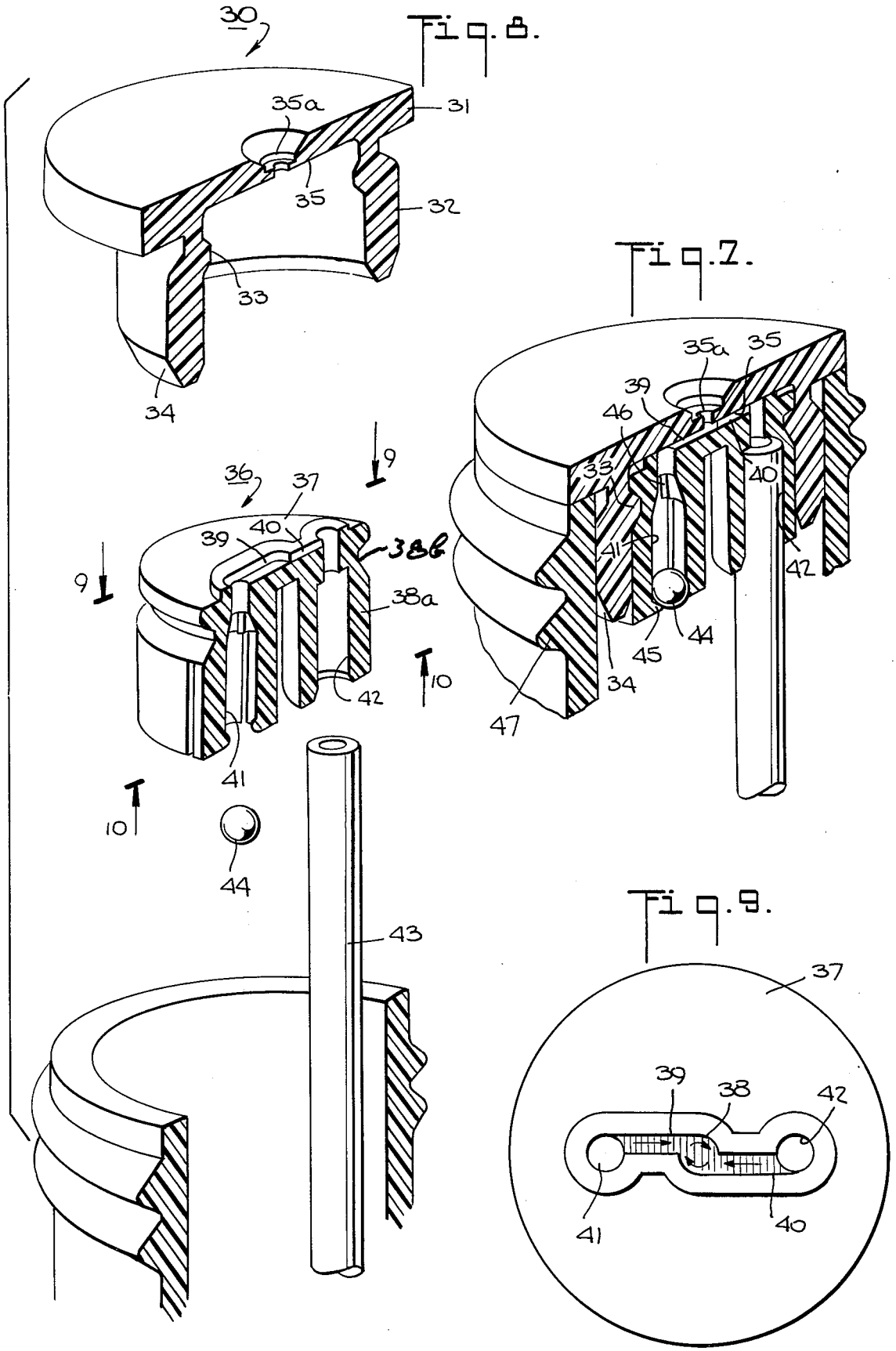
Figure 11:
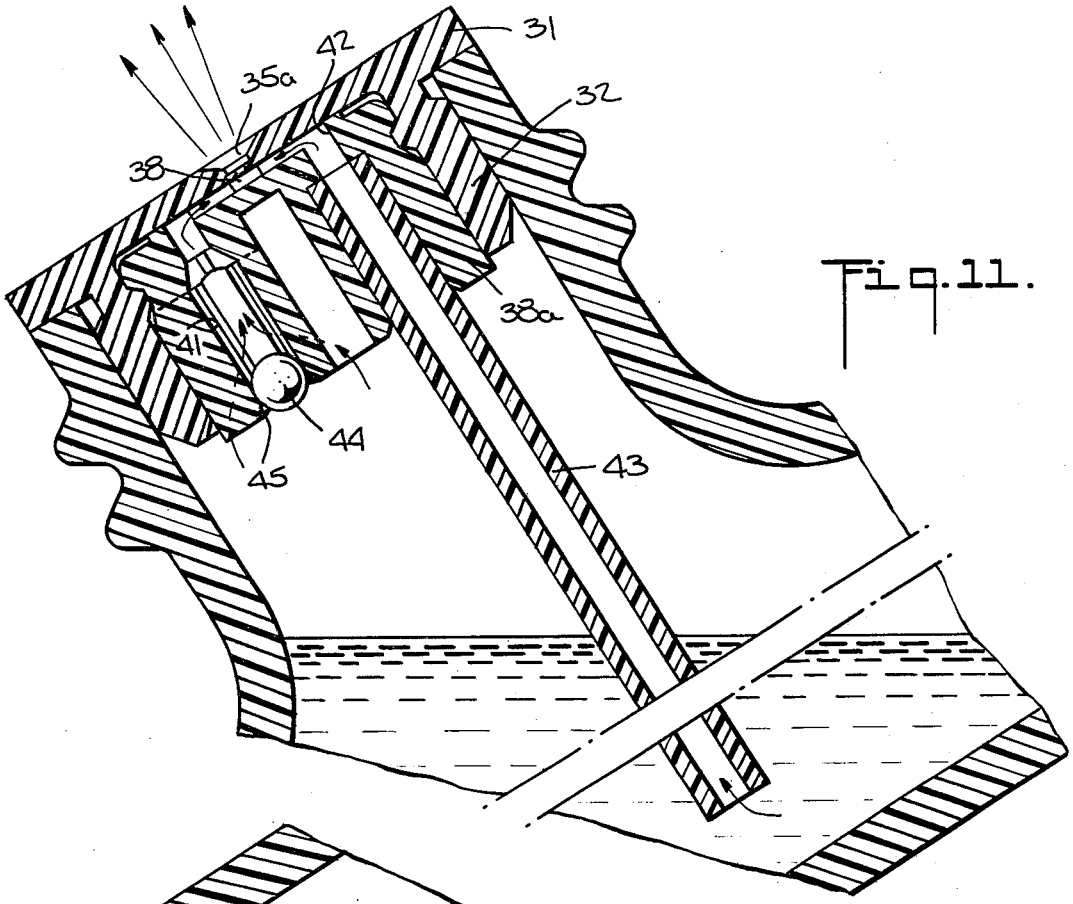
Figure 12:
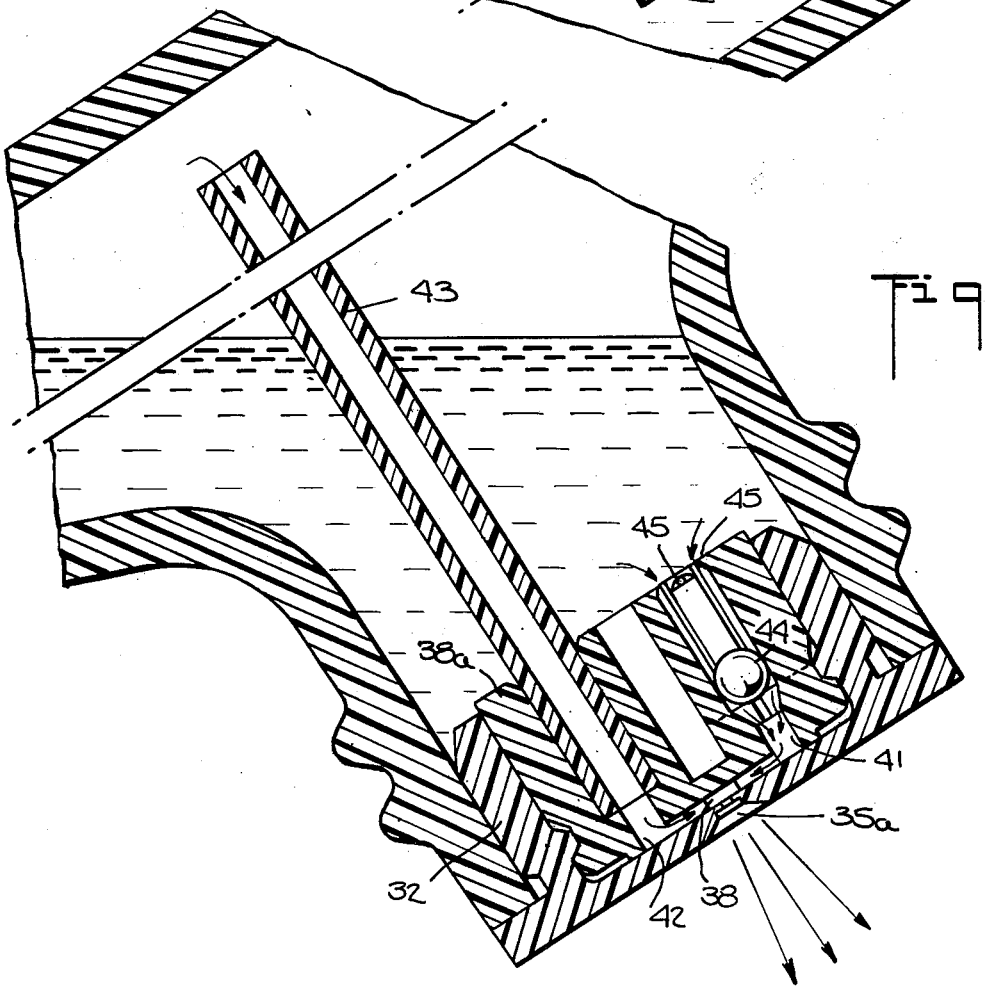

A second specific example of the present invention in its form designed for commercial production and sale is also illustrated by the accompanying drawings in which:

FIG. 7 in vertically cross-sectioned perspective, shows this second example;

FIG. 8 is an exploded view of FIG. 7;

FIG. 9 is a bottom view of the part defining the swirl chamber;

FIG. 10 is a bottom view of the assembly shown by FIG. 7;

FIG. 11 in cross section shows this second example as it operates in an upright position;

FIG. 12 is the same as FIG. 11 but shows the operation with the bottle upsidedown;

FIG. 13 in longitudinal section and greatly enlarged scale shows the details of the check valve means previously referred to as designed in the case of this second example;

FIG. 14 in vertical section shows a proposed modification of the second example;

FIG. 15 is a partially exploded view of this modification; and

FIG. 16 on an enlarged scale and in perspective, shows in detail the underside of a detail shown by FIG. 15.

DETAILED DESCRIPTION OF THE INVENTION

The above drawings show the prototype squeeze bottle 1 containing the liquid 2 and with the air space 3 which is above the liquid when the bottle is upright. The bottle has a removable cap 4 which is removed when the bottle is operated.

The bottle has a mouth 5 closed by a nozzle 6 contoured to form the swirl chamber 7 shown by FIG. 5, and having the opposed orifices 8 and 9 each provided with its own inlet 10 and 11, respectively.

Figure 3:
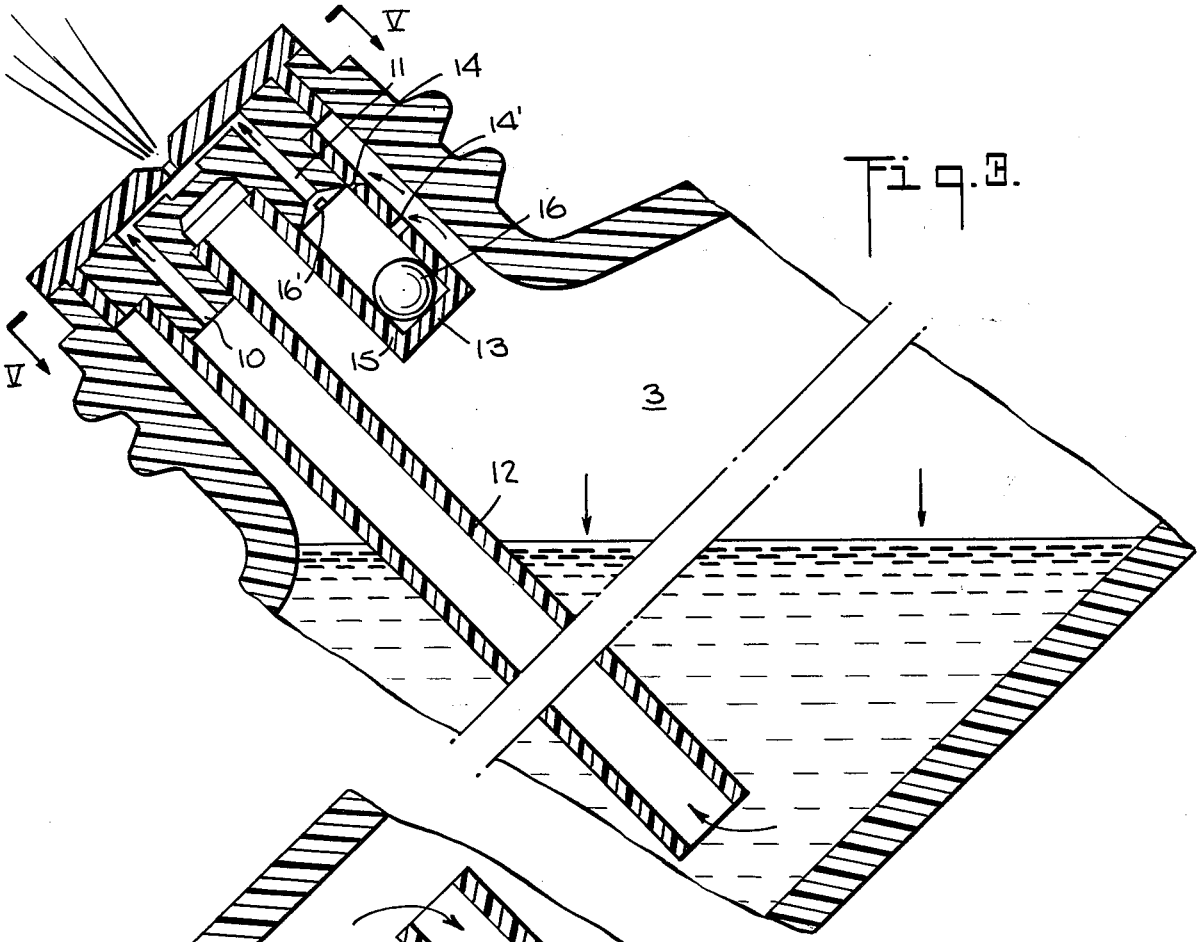
FIG. 3 in longitudinal section shows the operation involved when the bottle is upright.
Figure 4:
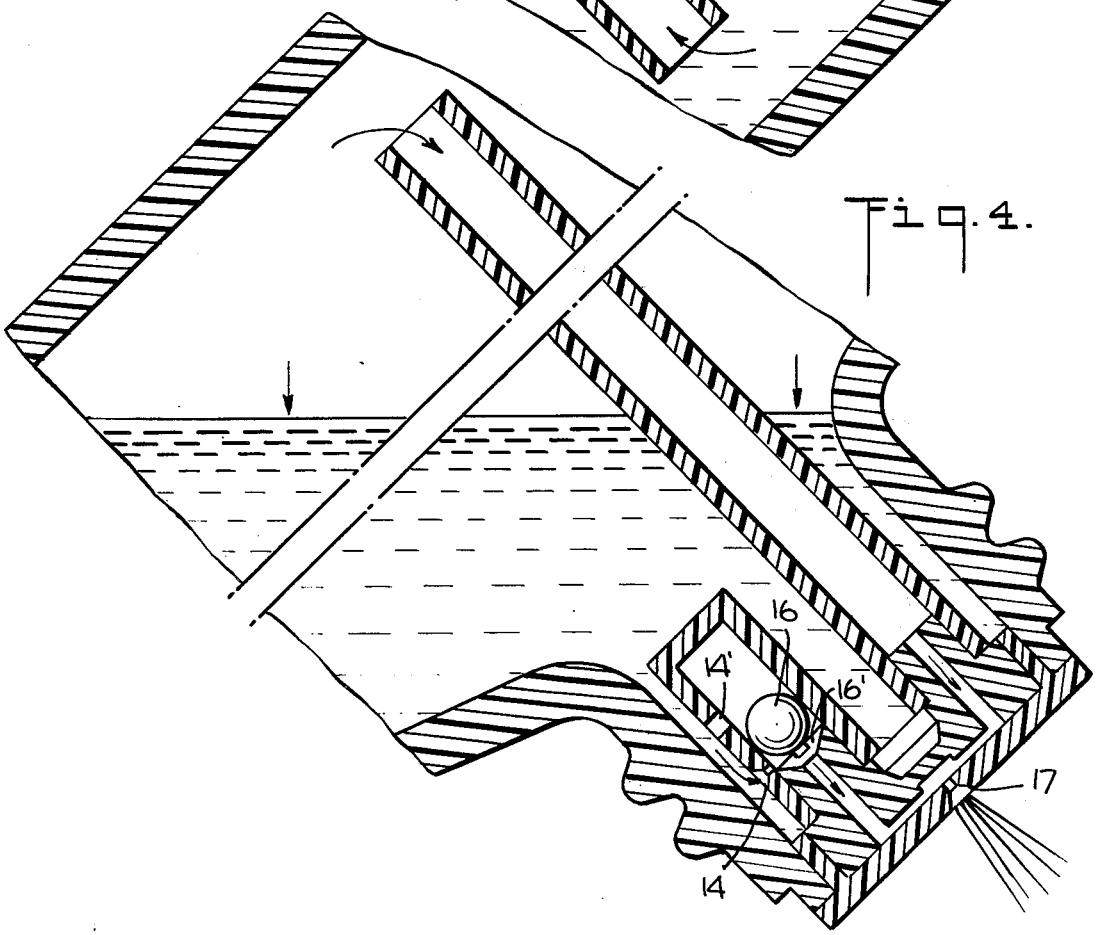
FIG. 4 is the same as FIG. 3 but shows the operation involved when the bottle is inverted.

As shown by FIGS. 2, 3 and 4, the inlet 10 is provided with a dip tube 12 that extends down into the liquid 2 near to the bottom of the bottle, when the bottle is upright. When the bottle is upright, the air space 3 is connected relatively freely through a check valve 13 via orifices 14 and 14' formed in the valve casing 15 above the check valve ball 16, which is gravitationally positioned in the bottom of the casing 15.

The two orifices 14 and 14' are proportioned to provide an air flow rate relative to the liquid flow rate through the dip tube 12 when the bottle is squeezed, so that in the swirl chamber 7 the air and liquid intermix for ejection through the swirl chamber's nozzle 17 in the form of an atomized spray.

When inverted, the check valve ball 16 rolls downwardly as shown by FIG. 4, to cut off the orifice 14' while permitting the liquid to flow through the relatively small orifice 14. A ball stop 16' prevents the ball from closing off the orifice 14. Now, when the bottle is squeezed, the air in the air space above the liquid flows through the dip tube into the swirl chamber, while the flow of liquid to the port 11 is restricted by the choke action of the orifice 15, thus preventing an excess of liquid from flowing into the swirl chamber.

The orifice 14 is designed with a much lower flow rate capacity than the orifice 14'. In other words, 14 is a much smaller hole than 14'. This is for the purpose of choking or restricting the flow of liquid to the swirl chamber during the inverted operation, while permitting an adequate flow, via both 14 and 14', during upright operation. By proper design of the orifice sizes of 14 and 14', of the swirl chamber orifices 8 and 9 and their inlets 10 and 11 respectively, the proportions of air and liquid required for proper atomization is always obtained whether the bottle is upright or inverted when operated.

FIG. 6 shows a modified form of check valve in which a tubular shuttle 18 is mounted in a casing 19 having a tapered orifice 20 which is fully open when the bottle is upright. When inverted, the shuttle 18 slides downwardly to block off the orifice 20 completely, while at the same time opening an orifice 21 in the inner end of the casing 19. In this case the full flow when the bottle is upright is via the orifice 20; in the inverted condition the restricted flow is via the orifice 21 and the inside of the tubular shuttle 18.

The foregoing and the drawing figures referred to there disclose the prototype squeeze bottle of the present invention substantially exactly, excepting that the squeeze bottle container was cylindrical instead of flask-like as illustrated. The individual parts were force fitted together and all parts were made of plastic excepting for the check valve ball which was made of metal. These individual parts differed in shape only very slightly from what is shown by FIGS. 2 through 5. The bottle per se was a commercially available squeeze bottle having the usual elastically flexible collapsibility under finger pressure by which is meant by hand-holding the bottle and finger squeezing in the usual manner.

The atomization referred to hereinabove is to the degree previously referred to, namely, a spray discharge having a small particle size and particle dispersion of sprays dispensed by an aerosol package. However, the internal pressure developed within the squeeze bottle of the prototype, is only the relatively very low pressure, such as possibly in the area of 5 psi, typically developed when a squeeze bottle is squeezed in the usual way. Therefore, it is surprising that an aerosol is produced which is completely competitive with the aerosol produced by an aerosol package powered at the much higher internal pressure by a liquefied gas propellant.

The present inventor is widely experienced in the aerosol package art, he has invented and patented various inventions in that field and he is experienced in the science and technology involved. He has not been able to develop a scientific explanation for why the prototype produces an aerosol, when in an otherwise familiar two-orifice swirl chamber, the present invention involving the introduction of only a gas or vapor through one orifice and the introduction of only a liquid product through the other, produces an atomization to such a degree that an aerosol is discharged via the swirl chamber's discharge orifice even though both fluids are pressurized only at the low pressures made available by squeeze bottle operation.

Apparently as the two components separately enter the swirl chamber tangentially in the same rotative direction and rotatively merge while relatively free from the turbulence characteristic of the prior art concepts exemplified by the Leong patent, the two components of differing phases smoothly intermix and swirlingly eject through the swirl chamber's discharge orifice to produce the aerosol. The prior art concept of the need for turbulence and flow direction reversals is apparently substantially absent, permitting the relatively low squeeze bottle pressure to effect atomization with the liquid having a particle size of aerosol dimensions.

The ability to reproduce the effectiveness of the prototype has now been proven by the design and production of a product made by plastic injection molding techniques as required for the commercial production of the millions of squeeze bottles needed to satisfy the commercial market.

This commercial design is illustrated by FIGS. 7 through 13 of the present application and is described in detail below.

As shown best by FIG. 8, an injection molded squeeze bottle cap 30 has a disk-like top 31 from which a skirt 32 depends which is formed closely below the bottom of the top 31 with an internal rib 33. The bottom of the skirt is champhered as at 34 for easy entry into a bottle mouth. The swirl chamber discharge orifice **35*a* is formed coaxially through the top 31. The bottom side 35 of the disk 31 is flat and the skirt 32** is of cylindrical contour.

A plastic injection molded inner plug 36 has a flat top 37 from which a cylindrical skirt **38*a* depends with an external groove 38*a* into which the annular rib 33 of the cap 30 snaps when the two parts are pressed together. The plastic has adequate elastic deformability to permit the parts to be thus fitted together. The flat top 37 has the swirl chamber 38 molded into it along with its two mutually opposite inlets 39 and 40 which open tangentially into the swirl chamber. As shown by FIG. 9, these inlets 39 and 40 are of even longer extent than in the case of the prototype as illustrated by FIG. 5. Through these relatively long inlets the low pressure flows of the two components can smooth out to at least an approximation of laminar flows, the two flows entering the swirl chamber 38 for smooth swirling together in the chamber. When the two parts 30 and 36 snap together, their respective flat surfaces 35 and 37 interfit so that the swirl chamber and its two inlets are enclosed. Incidentally, the inlet lengths shown by FIG. 5** are adequate for the production of the unique aerosol provided by this invention.

The inner plug 36 is molded to form two passageways 41 and 42, the latter frictionally receiving the dip tube 43 and connecting directly with the input end of the inlet 40. The other passageway 41 has its upper end connected with the other inlet passageway 39 and forms the check valve component.

This passageway 41 is defined by a plurality of depending cage bars or, in other words, is a vertically slotted passageway, and it contains the check valve ball 44 which slides up and down the slotted passageway while being retained from falling downwardly by the cage legs having their inner ends inwardly beaded at 45. To install the ball, it is snapped through the beads 45, the plastic parts giving elastically to permit this and then returning to hold the ball. When the squeeze bottle is used in its upright condition when the air passes through the check valve, a large flow rate capacity is provided above the ball by the slots between the vertical legs forming the passageway 41. In the inverted position the ball 44 rolls upwardly to the upper end of the passageway 41 where it is held in a slightly open position by the ribs 46 of the conical upper end of the passageway 41 and which opens into the inlet 39.

When the parts 30 and 36 are snapped together with the ball 44 snapped into its position, the entire squeeze bottle dispensing valve assembly is completed. Only the two plastic injection molded parts are needed, plus the ball made of metal or otherwise provided with suitable weight to be gravitationally effective. Because the ball cage is open to flow above the ball, the fluid flow cannot displace the ball upwardly during upright operation, in any event.

With the completed dispensing nozzle pushed into the mouth 47 of a squeeze bottle, the upright operation is illustrated by FIG. 11 and the inverted operation is shown by FIG. 12. The arrows indicate the flow paths. In FIG. 9 the two separated flows of liquid and air and their swirling together is also indicated by arrows. The discharge orifice 35*a* of the cap 30 is coaxially positioned with respect to the swirl chamber 38 immediately below the inlet end of the orifice 35*a*. The orifice feeding passageways or inlets 39 and 40 are symmetrically disposed on diametrically opposite sides of the swirl chamber 38 and are tangentially arranged with respect to the latter.

It is possible that for differing products it might be desired to redesign the swirl chamber and its orifices or feeding passageways. To make this possible, the proposal of FIGS. 14 through 16 is offered. In this case the flat top 37 of the inner plug 36 is formed with a flat recess comprising a cylindrical central portion 38' and oppositely extending wings 39' and 39'' with which the passageways 41 and 42 register. This recess receives a removable insert 50 and shown bottom-side-up by FIG. 16. It is in this recess that the swirl chamber 38 and its oppositely extending feeding or orifice passages or inlets 39 and 40 are formed, the insert providing a discharge orifice opening 35' which registers with the discharge orifice 35*a* in the cap 30 when the valve parts are assembled.

With the above arrangement the squeeze bottle manufacturer can provide the two main plastic parts, the cap and the plug, to the manufacturer of the product to be packaged, while making available differently designed inserts 50 each exactly designed for the specific liquid product to be packaged.

In the case of the previously described prototype, the swirl chamber had a diameter of 0.050inches and a depth of 0.040 inches, and the two swirl chamber inlet passages extending horizontally and tangentially into this swirl chamber were 0.020 inches by 0.020 inches. The vertical passages for both the air and the liquid were 0.047 inches in diameter and the ball check was 0.125 inches in diameter. The dip tube for the liquid had an internal diameter of 0.050 inches. The passage 14 and 14' of the prototype were empirically determined as required for a sufficient air mixture in an upright position and the orifice 14 was proportioned to prevent flooding of the swirl chamber when the prototype was in an inverted position.

In the case of the commercial design shown by FIGS. 11 and 12, for example, the following swirl chamber component dimension ranges apply:

Aerosol Discharge Orifice Sizes and Axial Lengths = .019" dia. × .025" length
.021" × .015"
.025" × .025"
.030" × .025"

| LIQUID PRODUCT | | | SWIRL CHAMBER | |
|---|---|---|---|---|
| Vertical Inlet | Horizontal Inlet | | Diameter | Depth |
| .047" dia. | .020" × | .020" | .050" dia. | .025" |
| .047 | .020 | .020 | .070 | .020 |
| .047 | .020 | .020 | .070 | .030 |
| .047 | .020 | .020 | .050 | .030 |
| .047 | .020 | .020 | .070 | .030 |
| .047 | .020 | .020 | .050 | .040 |

| AIR | | | BALL CHECK |
|---|---|---|---|
| Vertical Inlet | Horizontal Inlet | | Diameter |
| .047" dia. | .020" × | .020" | .093" dia. |
| .047 | .020 | .020 | .093 |
| .047 | .020 | .030 | .093 |
| .047 | .020 | .030 | .093 |
| .070 | .030 | .030 | .125 |
| .070 | .020 | .040 | .125 |

Dip Tube I.D. = .050" dia.
.097" dia.

As can be seen from FIG. 9 which is drawn substantially to scale, the inlet passages 39 and 40 are substantially longer than the diameter of the swirl chamber 38, thus providing for an exceptionally smooth introduction of the separated gas or vapor and liquid components, comparatively lightly pressurized, tangentially into the swirl chamber 38, for ejection via the nozzle orifice 35*a* as an aerosol.

For dispensing liquid products of possibly varying viscosity, the swirl chamber dimensions and the dimensions of the swirl chamber tangential injection orifices or injection inlets may be empirically determined so that the dispensing nozzle of this invention produces the kind of aerosol and spray pattern desired in the case of any liquid product to be packaged in a squeeze bottle or other container, for dispensing the product as an aerosol without the prior art requirement for relatively high pressurization of the product and air or vapor. The discharge orifice dimensions should be included in such an empirical determination.

What is claimed is:

1. A liquid dispensing package comprising a container containing the liquid and a gas or vapor above the liquid, said container being provided with a dispensing nozzle having a spray orifice opening from a swirl chamber having at least two tangential injection orifices, a first means for connecting one of said injection orifices with said liquid, a second means for connecting the other of said injection orifices with said space, and means for pressurizing said gas or vapor and said liquid, said swirl chamber forming a substantially flat circular space, said spray orifice opening axially and substantially centrally from said space and said injection orifices opening transversely into the periphery of said space and pointing in the same directions substantially tangentially with respect to said periphery, said space being an enclosed space other than for said orifice.

2. The package of claim 1 in which said container is a squeeze bottle and when squeezed provides said means for pressurizing said gas or vapor and said liquid.

3. The package of claim 1 in which said injection orifices are positioned substantially diametrically opposite to each other.

4. The package of claim 1 in which said nozzle has a wall through which said spray orifice is formed, the inside of said wall forming an end wall of said swirl chamber and the spray orifice and swirl chamber being coaxially aligned.

5. The package of claim 1 in which said swirl chamber has a diameter greater than the diameter of said spray orifice and said injection orifices have axially aligned feeding ducts which are substantially longer than the swirl chamber's diameter, said means connecting via said feeding ducts with said injection orifices.

6. The package of claim 1 in which the package is for anyway operation and said first means comprises a dip tube extending into said liquid and said second means comprises a check valve means for connecting with said space when said container is upright and providing a first flow rate and when the container is inverted for connecting with the liquid at a second flow rate which is less than the first flow rate.

7. A squeeze bottle containing a liquid product and an air space above the product and containing air, said bottle having a dispensing valve assembly forming a swirl chamber having a central axially extending discharge orifice and at least two tangential injection orifices, a dip tube connected with one of said orifices and dipping into said liquid product and means for connecting the other of said orifices with said air space, said swirl chamber, discharge orifice and injection orifices being relatively dimensioned so that an aerosol of the product is discharged via said discharge orifice upon manual squeezing of said bottle causing pressurization of the product and air so that they flow separately through said dip tube and means and said respective swirl chamber injection orifices and via said swirl chamber discharge through the discharge orifice, said swirl chamber forming a substantially flat circular space, said discharge orifice opening axially and substantially centrally from said space and said injection orifices opening transversely into the periphery of said space and pointing in the same directions substantially tangentially with respect to said periphery, said space being an enclosed space other than for said orifices so as to cause said product and air to swirl together in the same swirling direction in said space prior to said discharge.

8. A liquid dispensing package adapted for operation either upright or inverted and comprising a container containing a liquid and a space above the product when the container is upright or inverted, said container having a top provided with a dispensing nozzle having a spray orifice and internally forming a swirl chamber having injection orifices each having its own inlet, one of said orifices being provided with a dip tube extending into the liquid when the container is upright, the other one of said orifices having a check valve means for connecting it with said space when the container is upright and providing a first flow rate and when the container is inverted for connecting said other one with the liquid at a second flow rate which is less than said first flow rate, said space being adapted to contain a non-liquid under pressure, said swirl chamber forming a substantially flat circular space, said spray orifice opening axially and substantially centrally from said space and said injection orifices opening transversely into the periphery of said space and pointing in the same directions substantially tangentially with respect to said periphery, said space being an enclosed space other than for said orifices.

9. A liquid dispensing package adapted for operation either upright or inverted and comprising a container containing a liquid and a space above the product when the container is upright or inverted, said container having a top provided with a dispensing nozzle having a spray orifice and internally forming a swirl chamber having injection orifices each having its own inlet, and means for connecting said respective inlets alternately with said space and said liquid and which is responsive to inversion of said bottle, said swirl chamber forming a substantially flat circular space, said spray orifice opening axially and substantially centrally from said space and said injection orifices opening transversely into the periphery of said space and pointing in the same directions substantially tangentially with respect to said periphery, said space being an enclosed space other than for said orifices.

* * * * *